US005529555A

United States Patent [19]

Rodgers, Jr.

[11] Patent Number: 5,529,555

[45] Date of Patent: Jun. 25, 1996

[54] CRANK ASSEMBLY FOR AN EXERCISING DEVICE

[75] Inventor: Robert E. Rodgers, Jr., Houston, Tex.

[73] Assignee: CCS, LLC, Denver, Colo.

[21] Appl. No.: 467,596

[22] Filed: Jun. 6, 1995

[51] Int. Cl.[6] ..... A63B 69/16; A63B 22/04

[52] U.S. Cl. ..... 482/57; 482/51; 482/52; 482/70

[58] Field of Search ..... 482/51, 52, 53, 482/54, 57, 62, 70, 71, 74, 79, 80, 92

[56] References Cited

U.S. PATENT DOCUMENTS

| | | |
|---|---|---|
| 219,439 | 9/1879 | Blend . |
| 2,603,486 | 7/1952 | Hughes . |
| 3,316,898 | 5/1967 | Brown . |
| 3,432,164 | 3/1969 | Deeks . |
| 3,759,511 | 9/1973 | Zinkin et al. . |
| 4,053,173 | 10/1977 | Chase, Sr. . |
| 4,188,030 | 2/1980 | Hooper . |
| 4,379,566 | 4/1983 | Titcomb . |
| 4,456,276 | 6/1984 | Bortolin . |
| 4,509,742 | 4/1985 | Cones . |
| 4,555,109 | 11/1985 | Hartmann . |
| 4,561,318 | 12/1985 | Schirrmacher . |
| 4,645,200 | 2/1987 | Hix . |
| 4,679,786 | 7/1987 | Rodgers . |
| 4,720,093 | 1/1988 | Del Mar . |
| 4,869,494 | 9/1989 | Lambert, Sr. . |
| 4,900,013 | 2/1990 | Rodgers, Jr. . |
| 4,949,954 | 8/1990 | Hix . |
| 4,949,993 | 8/1990 | Stark et al. . |
| 4,989,857 | 2/1991 | Kuo . |
| 5,039,087 | 8/1991 | Kuo . |
| 5,039,088 | 8/1991 | Shifferaw . |
| 5,131,895 | 7/1992 | Rogers, Jr. . |
| 5,135,447 | 8/1992 | Robards, Jr. et al. . |
| 5,186,697 | 2/1993 | Rennex . |
| 5,242,343 | 9/1993 | Miller . |
| 5,290,211 | 3/1994 | Stearns . |
| 5,295,928 | 3/1994 | Rennex . |
| 5,299,993 | 4/1994 | Habing . |
| 5,383,829 | 1/1995 | Miller . |
| 5,401,226 | 3/1995 | Stearns . |
| 5,423,729 | 6/1995 | Eschenbach . |

FOREIGN PATENT DOCUMENTS

| | | |
|---|---|---|
| 2919-494 | 5/1979 | Germany . |

*Primary Examiner*—Stephen R. Crow
*Attorney, Agent, or Firm*—Marc L. Delflache; Pravel, Hewitt, Kimball & Krieger

[57] ABSTRACT

A crank assembly for use within an exercising device which promotes cardiovascular exercise yet minimizes impact on critical joints, particularly the ankles and knees. The crank assembly employs a dual coupler system which is interconnected for synchronized rotation. Linkage assemblies are provided which define a predetermined path having preferred anatomical pattern for foot movement of the user. The crank assembly can be used in an exercising device which promotes leg exercise primarily, or can be combined with two additional linkage assemblies to provide a combined hand motion with leg movement. In this manner, an enhanced cardiovascular workout is provided which minimizes stress on key joints, particularly the ankles and knees.

25 Claims, 2 Drawing Sheets

FIG. 4
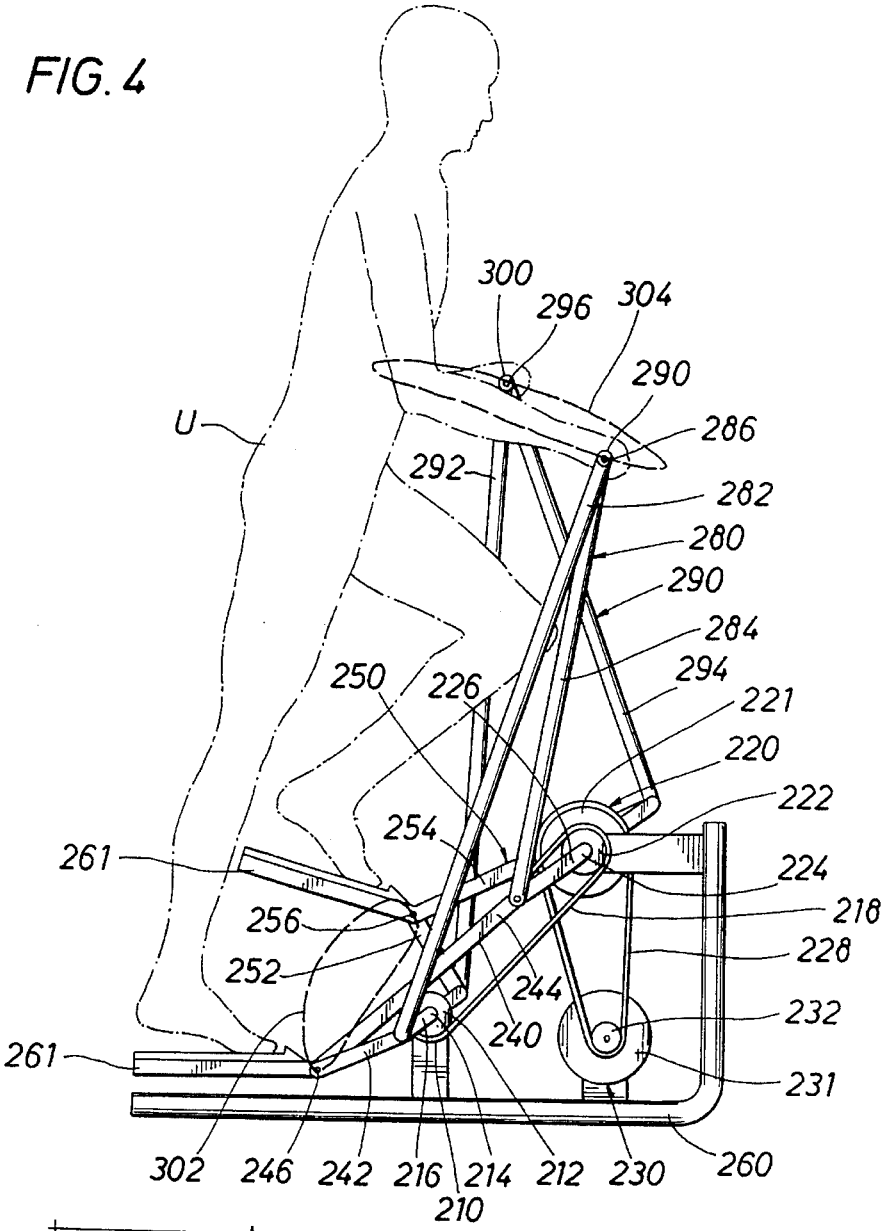
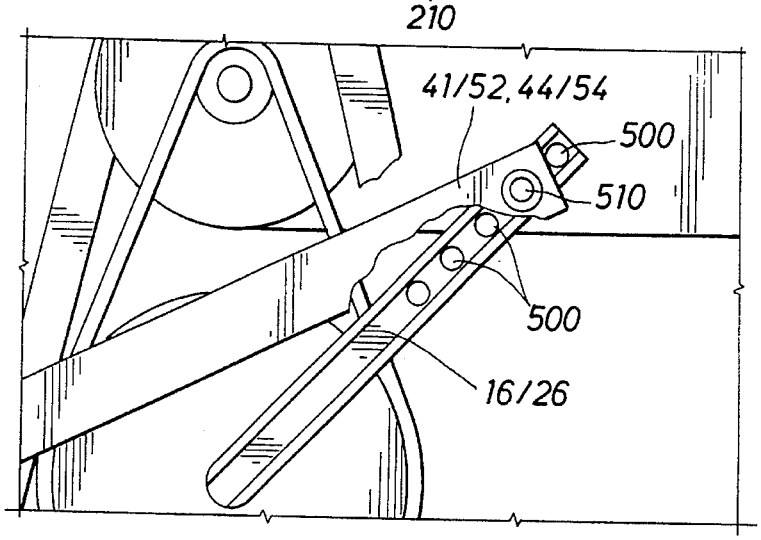
FIG. 5

CRANK ASSEMBLY FOR AN EXERCISING DEVICE

BACKGROUND OF THE INVENTION

1. Field of the Invention

The present invention relates to a crank assembly for an exercising device. More particular, the invention relates to a crank assembly for an exercising device which enables the user to move his feet and/or arms in a predetermined closed path.

2. Description of the Prior Art

Over the last several years, the public has become more conscious of the need for exercise to maintain good health. In particular various types of exercise devices have been developed which address this demand. Most of these devices utilize one or two exercising motions—circular (single crank path), arcuate (lever path), or linear (slider or roller path). However, these exercising motions are not always optimal and can induce excessive joint or muscle stress. Further, these three motions rarely duplicate in an accurate manner functional, real world motions and, therefore, can be unsatisfying to the user. The need exists for an improved mechanical system which can be used in various types of exercising machines that generates a controlled closed exercise motion more closely simulating functional, real world activities.

SUMMARY OF THE INVENTION

Briefly, the invention relates to an improved crank assembly for an exercising device that more accurately simulates body motion to minimize harmful stress on joints. The invention includes at least two linkage assemblies, each having two individual links. Each link of a linkage assembly is pivotally connected at one end. The invention also includes two coupler systems, each coupler system having pulley means which rotate about a discrete pivot axis and means for connecting the pulley means to one end of one link of each linkage assembly. In this manner, each linkage assembly is connected to both couplers. Means are also included for correlating the rotational movement of each pulley means of both couplers.

In the preferred embodiment, the invention provides a crank system which can be incorporated in a number of different manners to provide an exercising medium that will generate a predetermined closed path which permits cardiovascular exercises yet minimizes stress on the joints.

In an alternate embodiment, the invention includes the crank system of the preferred embodiment within a frame assembly. Additionally, each linkage assembly includes means for supporting and orienting each foot of the user so that each foot follows a predetermined closed path thereby permitting cardiovascular exercising yet minimizing stress on the joints by permitting the joints to move in a preferred anatomical pattern.

In an alternate embodiment of the present invention, a third and fourth linkage assembly are also included, each assembly having two links. One end of each link of both third and fourth linkage assemblies are pivotally connected at one end. The other end of each link of each third and fourth linkage assembly is pivotally connected to either the first or second coupler systems. In this manner, the third and fourth linkage assemblies each provide articulating motion for the hand of the user. Thus, for example, the left foot of the user would be supported by the first linkage assembly while the left hand would be operating the third linkage assembly. Similarly, the right foot of the user would be supported by the second linkage assembly and the right hand would be operating the fourth linkage assembly.

The more important features of this invention have been summarized rather broadly in order that the detailed description may be better understood. There are, of course, additional features of the invention which will be described hereafter which will also form the subject of the claims appended hereto.

BRIEF DESCRIPTION OF THE DRAWINGS

In order to more fully describe the drawings used in the detailed description of the present invention, a brief description of each drawing is provided.

FIG. 4 is an elevation view of another alternate embodiment of the present invention.

FIG. 5 is a detail view of a portion of the present invention.

DETAILED DESCRIPTION OF PRESENT INVENTION

Figure 1:
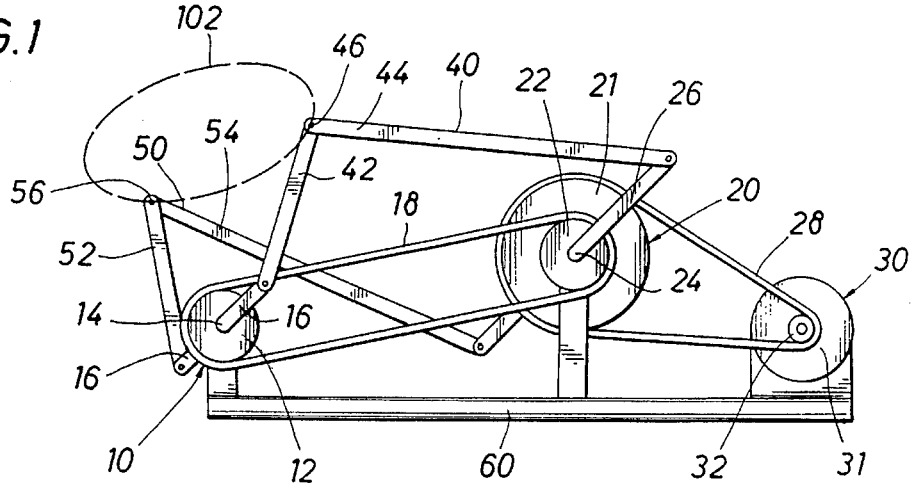
FIG. 1 is an elevation view of the preferred embodiment of the present invention.

Referring to FIG. 1 the present invention is shown comprising a first coupler 10 and a second coupler 20. First coupler 10 includes a pulley 12 pivotable about an axis 14. Cranks 16 are attached to pulley 12 at pivot axis 14 and extend radially outwardly therefrom. A belt or chain 18 circumscribes pulley 12. Second coupler 20 includes two pulleys 21 and 22 which coaxially rotate about a common pivot axis 24. Second coupler 20 also includes two cranks 26. Each crank 26 is attached at one end to either pulley 21 or 22 at the pivot axis 24 and extends radially outwardly therefrom. Belt or chain 18 also circumscribes the outer surface of pulley 22 thereby serving to synchronize the rotation of first coupler 10 and second coupler 20. A second belt 28 circumscribes the outer edge of pulley 21.

The present invention also includes a resistant brake system 30 comprising a resistant brake 31 which operates in a manner well known to those skilled in the art. Briefly, resistant brake 31 serves to increase or decrease the load on pulley 21 through the sheave 32/belt 28 arrangement. Thus, resistant brake system 30 serves to increase or decrease the extent of a cardiovascular workout.

The present invention also includes a first linkage assembly 40 and a second linkage assembly 50. First linkage assembly includes first link 42 and second link 44. One end of each first link 42 and second link 44 are pivotally connected at pin connection 46. The other end of first link 42 is pivotally connected to the outer end of one crank 16 of first coupler 20. The other end of second crank 44 is also pivotally connected to the outer end of one crank 26 of second coupler system 20. Similarly, second linkage assembly 50 includes first link 52 and second link 54. Again, one end of each first link 52 and second link 54 are pivotally connected at pin connection 56. The other end of first link 52 is pivotally connected to the outer end of the other crank 16 of first coupler 10. Similarly, the other end of second link 54 is pivotally connected to the outer end of the other crank 26 of second coupler 20. Preferably, first coupler 10, second coupler 20 and resistant brake system 30 are mounted to a common base 60. In this manner, a dual crank system is shown which can be used as the power assembly for various drive mechanisms of exercise devices.

Referring still to FIG. 1, movement of the first and second linkage assemblies 40/50 about first coupler 10 and second coupler 20 will result in pivot points 46 and 56 defining a predetermined closed path as generally shown by path 102. The particular shape of path 102 as well as the speed at which pivot points 46 and 56 circumscribe path 102 will be influenced by the lengths of cranks 16 and 26, the lengths of links 42/44 of first linkage assembly 40 and links 52/54 of second linkage assembly 50, the distance between axes 14 and 24 of pulleys 12 and 22, respectively, and varying the phase angles between cranks 16 and 26 (for example, having crank 16 at the 10:30 location when crank 26 is at the 1:30 location).

Figure 2:
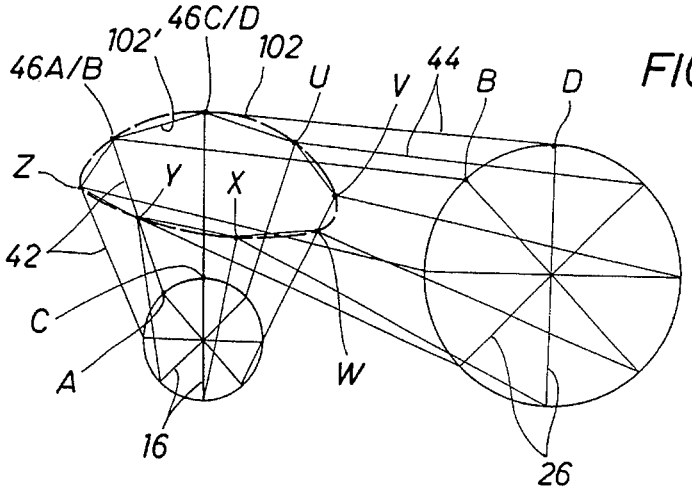
FIG. 2 is a schematic representation of a portion of the present invention.

The significance of such a velocity profile is more clearly shown by referring to FIG. 2. FIG. 2 illustrates the circular paths of the outer end of a crank 16 of first coupler 10 and a crank 26 of second coupler 20. Each circular path is divided into eight equidistant sectors (at 45° increments). Also shown are the corresponding links for either the first or second linkage assemblies at the pivot point of the outer edge of each crank. For example, referring to FIG. 2, first linkage assembly 40 is shown with links 42/44. Reference is first made to point A which defines a location at the 10:30 location on the circle defined by the rotation of crank 16. This point is the pivot point for one end of link 42. Also shown at point B is the 10:30 location on the circle defined by the rotation of a crank 26. This is also shown as the pivot point of one end of link 44 connected to crank 26. Extending outwardly from points A and B with links 42 and 44, respectively, results in their intersection at point 46 which is noted as pivot point 46A/B in FIG. 2. Similarly, points C and D define the 12:00 position of the rotation of cranks 16 and 26. Once again, following the intersection of links 42 and 44 from points C and D outwardly identifies point 46C/D. Continuing this pattern throughout the rotation of the cranks 16 and 26 coupled with the intersection of links 42 and 44 shows that the rotation of each set of cranks within a 45° arc of the circle generates different lengths on the path 102 but within the same time period. Path 102 as shown in a darker line in FIG. 2 is the flattened elliptical shape based on the smooth curved connection of the eight points defining path 102'.

The velocity of point 46 between points A/B and C/D is slower than between points X and Y. On the other hand, as point 46 rounds the corner of path 102 between points V and W, point 46 slows down. Thus, based on the present invention, it is possible to vary the configuration of path 102 as defined by points 46 and 56 and to modify the velocity of these points about path 102.

Figure 3:
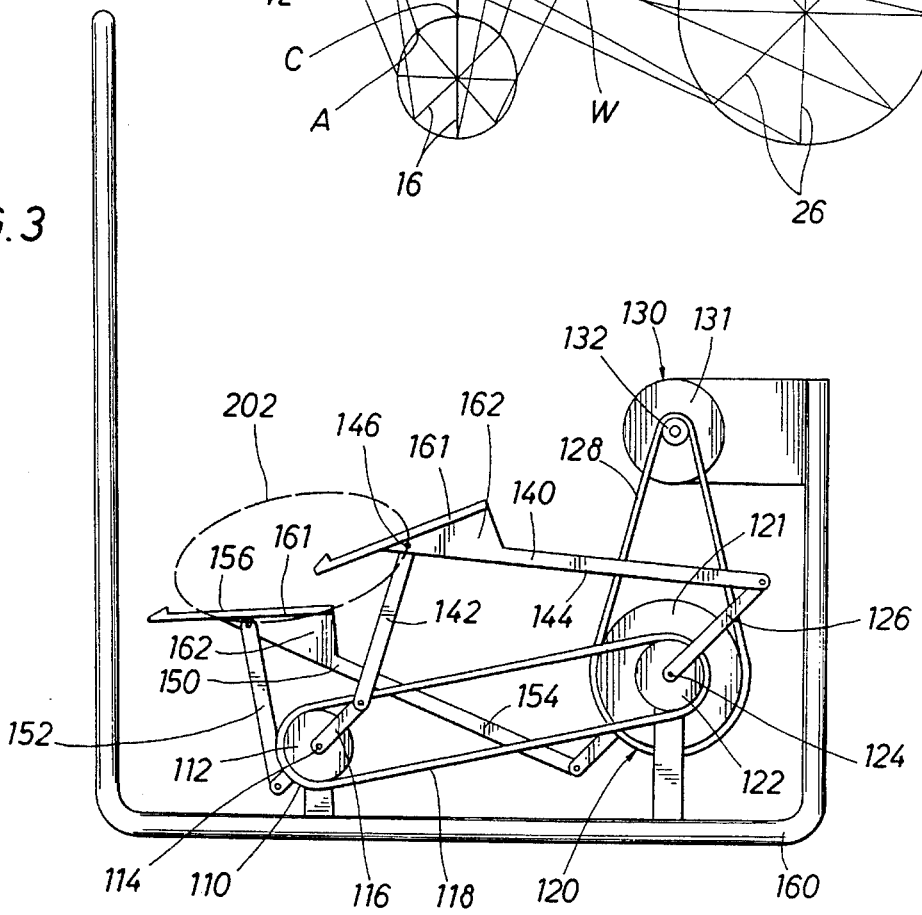
FIG. 3 is an elevation view of an alternate embodiment of the present invention.

Referring now to FIG. 3, an alternate embodiment of the present invention is shown. For this embodiment, identical two-digit reference numerals will be used to designate similar structure found in the preferred embodiment but with a 100 series prefix.

In this alternate embodiment, a frame 160 supports a first coupler 110 having a pulley 112 which rotates about an axis 114. Two cranks 116, each attached at one end to pulley 112, extend outwardly therefrom. This alternate embodiment also includes a second coupler 120 having a first pulley 121 and a second pulley 122 which rotate about a common pivot axis 124. Pulley 112 and pulley 122 are engaged by means of a belt or chain 118.

This alternate embodiment also includes a resistant brake system 130 similar in operation and configuration to brake system 30 of the preferred embodiment. Resistant brake system 130 includes resistant brake 131 and a sheave 132. A belt 128 is used to engage the braking system 130 with the second coupler 120.

A first linkage assembly 140 is also included having a first link 142 and a second link 144. A second linkage assembly 150 is also included having a first link 152 and a second link 154. Each second link 144/154 also includes a foot support 161 proximate that end of each second link 144/154 to the pin connection 146/156 with each first links 142/152. Each foot support 161 may include a wedge-shaped section 162 to assist in orienting the bottom of each foot of the user relative to the longitudinal axis of second links 144/154. This results in a preferred angle which is more ergonomically correct.

In the operation of this alternate embodiment, the user ascends the device and place one foot on each support 161. As the climbing or exercising motion begins, pivot points 146/156 define a path 202 which is of a predetermined shape having a preferred anatomical pattern. Thus, a minimal amount of stress is placed on the joints. Furthermore, by varying the length of cranks 116 and 126 in combination with the lengths of first links 142/152 and second links 144/154, the geometric configuration of path 202 can be varied to, for example, flatten the general elliptical configuration shown by path 202, or lengthen the axis of the path, or increase the height of the path to a more round or circular configuration. The particular shape desired will be apparent to those skilled in the art in view of this disclosure.

Referring now to FIG. 4, another alternate embodiment of the present invention is shown. As before, similar parts will be designated by the same two-digit reference numerals as shown in the preferred embodiment, but now with a 200 series prefix. A frame 260 is provided supporting a first coupler 210 having a pulley 212 and two cranks 216. Pulley 212 revolves about pivot axis 214. Also included in this alternate embodiment is a second coupler 220 comprising a first pulley 221 and a second pulley 222 which rotate around a common pivot axis 224. Pulleys 212 and 222 are interconnected by a belt or chain 218.

This alternate embodiment also includes a resistant brake system 230 which includes a resistant brake 231 and a sheave 232. A belt or chain 228 interconnects resistant brake 231 with pulley 221. Thus, in the operation of the device, an increased load can be placed on the exercising system by increasing the resistance offered by braking system 230. In this manner, resistant brake system 230 serves to increase or decrease the extent of the cardiovascular workout depending upon the adjustment made. The use of such a brake system 230 is well known to those skilled in the art.

This alternate embodiment also includes a first linkage assembly 240 having a first link 242 and a second link 244. One end of each link 242 and 244 are pivotally connected through a pin connection 246. The other end of first link 242 is connected to the outer end of crank 216 of first coupler 210. Similarly, the other end of second link 244 is pivotally connected to crank 226 of second coupler 220.

This alternate embodiment also includes a second linkage assembly 250 having a first link 252 and a second link 254. One end of link 254 is pivotally connected to the one end of link 252 at a pin connection 256. As in the case of the preferred embodiment, the other end of link 252 is pivotally connected to the outer end of crank 216. Similarly, the other end of link 254 is pivotally connected to the other end of crank 226.

In this alternate embodiment, second links 244 and 254 also include a foot support 261 proximate that end of each second link 244/254 to the pin connection 246/256. Each foot 261 is oriented relative to the longitudinal axis of each second link 254 between the pivot connections to provide a preferred inclination for ergonomical reasons. As shown in FIG. 4, this inclination is at an acute angle upwardly from the longitudinal axis due to the relative orientation of the first and second coupler 210/220.

This alternate embodiment also includes a third linkage assembly 280 comprising a first link 282 and a second link 284. One end of each link 282 and 284 is pivotally connected to one another at pin connection 286. The other end of first link 282 is pivotally connected to the outer end of crank 216, as is the first link 242. The other end of second link 284 of third linkage assembly 280 is pivotally connected to the outer end of crank 286, as is link 244. A handle 290 is attached at pin connection 286.

This alternate embodiment also includes a fourth linkage assembly 290 comprising a first link 292 and a second link 294. One end of each link 292 and 294 is pivotally connected to one another at pin connection 296. The other end of first link 292 is pivotally connected to the outer end of crank 216, as is first link 252. The other end of link 294 is pivotally connected to the outer end of crank 226, as is link 254. The fourth linkage assembly also includes a handle 300 which is attached to pin connection 296, and also may be grasped by the user during operation of the present invention.

In the operation of this alternate embodiment, the user ("U") ascends the device from the back and beings a climbing motion with his feet and an oscillating motion with his hands. In this manner, the first and second linkage assemblies begin to pivot and serve to define a predetermined closed path illustrated by the path 302. This path is defined by the movement of pin connection 246 and 256. Similarly, such climbing motion of the feet coupled with the oscillating action of the arms with the third and fourth linkage assemblies serve to result in the movement of the hands at the handles 286/296 in a closed predetermined path 304. In this manner, the user can achieve superior cardiovascular workout associated with climbing but without the awkward and unnatural movement of the feet, ankles and legs associated with prior art devices. Additionally, the movement of the arms serves to enhance the cardiovascular workout and also serves to exercise the upper body. The user can set the resistant load provided by brake system 230 to increase or decrease the load being placed on the coupler systems 210/220 to increase or decrease the energy required to operate the device.

As in the case of the preferred embodiments, the length of cranks 216 and 226 and the lengths of all links of the four linkage assemblies can be adjusted to vary the configuration of closed paths 302 and 304. Additionally, as discussed above, due to the difference in the lengths of cranks 216 and 226, the velocity of pivot points 246/256/286/296 about the closed paths can be modified based on the lengths of cranks 216 and 226 and the links of the four linkage assemblies.

FIG. 5 is a detail view of a portion of the present invention which illustrates the adjustable nature of cranks 16/26 in the preferred embodiment or the corresponding cranks of the first and second couplers in either alternate embodiment. Apertures 500 are included along the length of each crank 16/26. Thus, first links 42/52 or second links 44/54 of the preferred embodiments, or corresponding members of either alternate embodiment, may be attached to the corresponding crank 16/26 at the various apertures 500 by a pin member 510. In this manner, the user has yet another means to adjust the length of the crank, further modifying the shape of the closed path 102 and the corresponding velocity profile.

An improved crank assembly for an exercising assembly is disclosed which maximizes cardiovascular exercise yet minimizes stress on critical joints, particularly the ankles and knees. Obviously, modifications and alterations to the embodiments disclosed herein will be apparent to those skilled in the art in view of this disclosure. However, it is intended that all such variations and modifications which fall within the spirit and scope of the invention as claimed.

What is claimed is:

1. A crank assembly for an exercising device comprising:

first linkage assembly including first and second links, means for supporting the foot of the user, each link having a first and second end and being pivotally connected to one another proximal the second end of each link;

second linkage assembly including first and second links, means for supporting the foot of the user, each link having a first and second end and being pivotally connected to one another proximal the second end of each link;

first coupler having pulley means adapted for rotational movement about a first pivot axis and means for connecting said pulley means to the first end of each first link of said first and second linkage assemblies;

second coupler having pulley means adapted for rotational movement about a second pivot axis and means for connecting said pulley means of said second coupler to the first end of each second link of said first and second linkage assemblies; and means for correlating the rotational movement of said pulley means of said first coupler with the rotational movement of said pulley means of said second coupler.

2. The crank assembly according to claim 1 wherein said assembly further comprises:

a third linkage assembly including first and second links, each link having a first and second end and being pivotally connected to one another proximal the second end of each said link of said third linkage assembly, and said first end of said first link of said third linkage assembly being pivotally connected to said connecting means of said first coupler and said first end of said second link of said third linkage assembly being pivotally connected to said connecting means of said second coupler; and a fourth linkage assembly including first and second links, each link having a first and second end and being pivotally connected to one another proximal the second end of each link of said fourth linkage assembly, and said first end of said first link of said fourth coupler assembly being pivotally connected to said connecting means of said first coupler and said first end of said second link of said fourth linkage assembly being pivotally connected to said connecting means of said second coupler.

3. The crank assembly according to claim 1 wherein said assembly further comprises:

a third linkage assembly including first and second links, each link having a first and second end and being pivotally connected to one another at said second end of each link, said first end of said first link of said third linkage assembly being pivotally connected to said first coupler and said first end of said second link of said third linkage assembly being pivotally connected to said second coupler; and a fourth linkage assembly including first and second links, each link having a first and second end and being pivotally connected to one another at said second end of each link, said first end of said first link of said fourth linkage assembly being pivotally connected to said first coupler and said first end of said second link of said fourth linkage assembly being pivotally connected to said second coupler.

4. The crank assembly according to claim 1 wherein said second link of said first and second linkage assemblies includes said means for supporting a foot of the user.

5. The crank assembly according to claim 2 wherein each said third and fourth linkage assembly includes handle means.

6. The crank assembly according to claim 1 wherein said second link of said first and second linkage assemblies includes said means for supporting a foot of the user so that during operation of the assembly each foot of the user follows a predetermined closed path having a preferred anatomical pattern.

7. The crank assembly according to claim 2 wherein said first and second linkage assemblies include said means for supporting a foot of the user so that during operation of the assembly each foot of the user follows a predetermined closed path having a preferred anatomical pattern.

8. The crank assembly according to claim 2 wherein each said third and fourth linkage assembly includes a handle means so that during operation of the assembly each hand of the user follows a predetermined closed path having a preferred anatomical pattern.

9. The crank assembly according to claim 3 wherein each said third and fourth linkage assemblies include a handle means so that during operation of the assembly each hand of the user follows a predetermined closed path having a preferred anatomical pattern.

10. The crank assembly according to claim 1 wherein said connecting means of said first coupler comprises:

a first element attached at one end to said pulley means proximate said first pivot axis and at its other end to the first end of said first link of said first linkage assembly; and a second element attached at one end to said pulley means proximate said first pivot axis and at its other end to said first end of said first link of said second linkage assembly.

11. The crank assembly according to claim 10 wherein said connecting means of said second coupler comprises:

a first element attached at one end to said pulley means proximate said first pivot axis and at its other end to the first end of said first link of said first linkage assembly; and a second element attached at one end to said pulley means proximate said first pivot axis and at its other end to said first end of said first link of said second linkage assembly.

12. The crank assembly according to claim 1 wherein said assembly further comprises means for introducing a resistive force to said pulley means of said second coupler so that rotation of said pulley means of said second coupler becomes progressively more difficult.

13. The crank assembly according to claim 1 wherein said crank assembly further comprises means for introducing a resistive force to said pulley means of said first and second coupler so that rotation of said pulley means of said first and second coupler becomes progressively more difficult.

14. The crank assembly according to claim 10 wherein said first element includes means to adjust the length of said first element about said pivot axis and said second element about said pivot axis.

15. The crank assembly according to claim 10 wherein said first element comprises means to adjust the length of said first element and said second element comprises means to adjust the length of said second element.

16. The crank assembly according to claim 1 wherein said first linkage assembly includes means to adjust the length of said first and second link between said first and second ends of each said first and second links.

17. The crank assembly according to claim 1 wherein said second linkage assembly includes means to adjust the length of said first and second link between said first and second ends of each of said first and second links.

18. The crank assembly according to claim 2 wherein said first and second links of said third linkage assembly includes means to adjust the length of said first and second links between said first and second ends of each said first and second links of said third linkage assembly.

19. The crank assembly according to claim 2 wherein said first and second links of said fourth linkage assembly includes means to adjust the length of said first and second links between said first and second ends of each said first and second links of said fourth linkage assembly.

20. A crank assembly for an exercising device comprising:

first linkage assembly including first and second links, means for supporting the foot of the user, each link having a first and second end and being pivotally connected to one another proximal the second end of each link;

second linkage assembly including first and second links, means for supporting the foot of the user, each link having a first and second end and being pivotally connected to one another proximal the second end of each link;

first coupler having pulley means adapted for rotational movement about a first pivot axis and means for connecting said pulley means to the first end of each first link of said first and second linkage assemblies;

second coupler having pulley means adapted for rotational movement about a second pivot axis and means for connecting said pulley means of said second coupler to the first end of each second link of said first and second linkage assemblies;

third linkage assembly including first and second links, each link having a first and second end and being pivotally connected to one another proximal the second end of each of said links of said third linkage assembly, and said first end of said first link of said third linkage assembly being pivotally connected to said connecting means of said first coupler and said first end of said second link of said third linkage assembly being pivotally connected to said connecting means of said second coupler;

a fourth linkage assembly including first and second links, each link having a first and second end and being pivotally connected to one another proximal the second end of each link of said fourth linkage assembly, and said first end of said first link of said fourth coupler assembly being pivotally connected to said connecting means of said first coupler and said first end of said second link of said fourth linkage assembly being pivotally connected to said connecting means of said second coupler; and means for correlating the rotational movement of said pulley means of said first coupler with the rotational movement of said pulley means of said second coupler.

21. A crank assembly for an exercising device comprising:

first linkage assembly including first and second links, means for supporting the foot of the user, each link having a first and second end and being pivotally connected to one another proximal the second end of each link;

second linkage assembly including first and second links, means for supporting the foot of the user, each link having a first and second end and being pivotally connected to one another proximal the second end of each link;

first coupler having pulley means adapted for rotational movement about a first pivot axis and means for connecting said pulley means to the first end of each first link of said first and second linkage assemblies;

second coupler having pulley means adapted for rotational movement about a second pivot axis and means for connecting said pulley means of said second coupler to the first end of each second link of said first and second linkage assemblies;

a third linkage assembly including first and second links, each link having a first and second end and being pivotally connected to one another proximal the second end of each of said links of said third linkage assembly, said first end of said first link of said third coupling assembly being pivotally connected to said first coupler and said first end of said second link of said third linkage assembly being pivotally connected to said second coupler;

a fourth assembly including first and second links, each link having a first and second end and being pivotally connected to one another proximal the said second end of each link of said fourth linkage assembly, and said first end of said first link of said third linkage assembly being pivotally connected to said first coupler and said first end of said second link of said fourth linkage assembly being pivotally connected to said second coupler; and means for correlating the rotational movement of said pulley means of said first coupler with the rotational movement of said pulley means of said second coupler.

22. An exercising device comprising:

a frame;

first linkage assembly including first and second links, means for supporting the foot of the user, each link having a first and second end and being pivotally connected to one another proximal the second end of each link, said second link having means to support the foot of a user proximate its second end;

second linkage assembly including first and second links, means for supporting the foot of the user, each link having a first and second end and being pivotally connected to one another proximal the second end of each link, said second link of said second linkage assembly having means to support the foot of a user proximate its second end;

first coupler having pulley means adapted for rotational movement about a first pivot axis and means for connecting said pulley means to the first end of each first link of said first and second linkage assemblies, said first coupler being attached to and supported by said frame;

second coupler having pulley means adapted for rotational movement about a second pivot axis and means for connecting said pulley means of said second coupler to the first end of each second link of said first and second linkage assemblies, said second coupler being attached to and supported by said frame; and means for correlating the rotational movement of said pulley means of said first coupler with the rotational movement of said pulley means of said second coupler, wherein said foot support means follow a predetermined closed path having a preferred anatomical pattern during operation of the device.

23. An exercising device comprising:

a frame;

first linkage assembly including first and second links, each link having a first and second end and being pivotally connected to one another proximal the second end of each link, said second link having means to support the foot of a user proximate its second end;

second linkage assembly including first and second links, each link having a first and second end and being pivotally connected to one another proximal the second end of each link, said second link of said second linkage assembly having means to support the foot of a user proximate its second end;

first coupler having pulley means adapted for rotational movement about a first pivot axis and means for connecting said pulley means to the first end of each first link of said first and second linkage assemblies, said first coupler being attached to said frame;

second coupler having pulley means adapted for rotational movement about a second pivot axis and means for connecting said pulley means of said second coupler to the first end of each second link of said first and second linkage assemblies, said second coupler being attached to said frame;

a third linkage assembly including first and second links, each link having a first and second end and being pivotally connected to one another proximal the second end of each of said links of said third linkage assembly, said first end of said first link of said third coupling assembly being pivotally connected to said first coupler and said first end of said second link of said third linkage assembly being pivotally connected to said second coupler, said third linkage assembly further including a handle means proximate said pivotal connection of the second ends of said first and second links of said third linkage assembly;

a fourth assembly including first and second links, each link having a first and second end and being pivotally connected to one another proximal the second end of each link of said fourth linkage assembly, and said first end of said first link of said third linkage assembly being pivotally connected to said first coupler and said first end of said second link of said fourth linkage assembly being pivotally connected to said second coupler, said fourth linkage assembly further including a handle means proximate said pivotal connection of the second ends of said first and second links of said fourth linkage assembly; and means for correlating the rotational movement of said pulley means of said first coupler with the rotational movement of said pulley means of said second coupler, wherein said foot support means and said handle means follow predetermined closed paths having preferred anatomical patters during operation of the device.

24. The exercising device according to claim 23 wherein said device further comprises means for introducing a resistive force to said pulley means of said second coupler so that rotation of said pulley means of said second coupler becomes progressively more difficult.

25. The exercising device according to claim 23 wherein said device further comprises means for introducing a resistive force to said pulley means of said first and second coupler so that rotation of said pulley means of said first and second coupler becomes progressively more difficult.

* * * * *